US008577065B2

(12) United States Patent
Lau

(10) Patent No.: US 8,577,065 B2
(45) Date of Patent: Nov. 5, 2013

(54) SYSTEMS AND METHODS FOR CREATING IMMERSION SURROUND SOUND AND VIRTUAL SPEAKERS EFFECTS

(75) Inventor: Harry K Lau, Norwalk, CA (US)

(73) Assignee: Conexant Systems, Inc., Irvine, CA (US)

( * ) Notice: Subject to any disclaimer, the term of this patent is extended or adjusted under 35 U.S.C. 154(b) by 360 days.

(21) Appl. No.: 12/814,425

(22) Filed: Jun. 11, 2010

(65) Prior Publication Data

US 2010/0316224 A1 Dec. 16, 2010

Related U.S. Application Data

(60) Provisional application No. 61/186,795, filed on Jun. 12, 2009.

(51) Int. Cl.
*H04R 5/02* (2006.01)

(52) U.S. Cl.
USPC ..... 381/310; 381/17; 381/119; 381/97; 381/98

(58) Field of Classification Search
USPC ..... 381/1, 17, 61, 97, 98, 300, 309, 310, 381/119
See application file for complete search history.

(56) References Cited

U.S. PATENT DOCUMENTS

| | | | | | |
|---|---|---|---|---|---|
| 3,214,519 | A | * | 10/1965 | Fouque | 381/63 |
| 4,308,423 | A | * | 12/1981 | Cohen | 381/1 |
| 4,394,536 | A | * | 7/1983 | Shima et al. | 381/1 |
| 4,980,914 | A | * | 12/1990 | Kunugi et al. | 381/1 |
| 5,420,929 | A | * | 5/1995 | Geddes et al. | 381/1 |
| 5,724,429 | A | * | 3/1998 | Banerjea | 381/1 |
| 5,822,437 | A | * | 10/1998 | Winterer | 381/1 |
| 5,850,454 | A | * | 12/1998 | Hawks | 381/1 |
| 5,995,631 | A | * | 11/1999 | Kamada et al. | 381/1 |
| 6,111,958 | A | * | 8/2000 | Maher | 381/17 |
| 6,996,239 | B2 | * | 2/2006 | Wood | 381/17 |
| 7,035,413 | B1 | * | 4/2006 | Waller et al. | 381/17 |
| 8,064,624 | B2 | * | 11/2011 | Neugebauer et al. | 381/310 |
| 2009/0220110 | A1 | * | 9/2009 | Bazarjani et al. | 381/120 |
| 2010/0316224 | A1 | | 12/2010 | Lau | |

OTHER PUBLICATIONS

Dolby Virtual Speaker Technology: Fundamental Principles; 5 pages; Jan. 1, 2009.
Inside PHAT Stereo 3D Sound Enhancement Technology; 4 pages; Apr. 2008.
Aureal; Aureal's License Deliverables; Rockwell/Aureal Cross-Licensing Agreement; 3 pages; Mar. 10, 1997.
Rockwell Semiconductor Systems; AMC '97 (20424) Specification, Version 0.02; Jun. 13, 1998.
Ecoustics.com; Understanding Speaker Frequency Response; 12 pages; Apr. 9, 2005.

(Continued)

*Primary Examiner* — Xu Mei
*Assistant Examiner* — Con P Tran
(74) *Attorney, Agent, or Firm* — Jackson Walker L.L.P.; Christopher J. Rourk

(57) ABSTRACT

Modern electronic devices are getting more portable and smaller leading to smaller distances between speakers. In particular, computers are now so compact that the notebook computer is one of the most popular computer types. However, with the proliferation of media available in digital form, both music recordings and video features, the demand for high quality reproductions on computers has increased. Systems and methods for producing wider speaker effects and immersion effects disclosed can enhance a listener's experience even in a notebook computer.

20 Claims, 8 Drawing Sheets

(56) References Cited

OTHER PUBLICATIONS

Analog Dialogue; A Forum for the Exchange of Circuits, Systems, and Software for Real-World Signal Processing; vol. 31, No. 3, Jan. 1, 1997.

Analog Devices; SoundPort Controller; AD1816A, Jan. 1, 1997.

Analog Devices; AC'97 SoundPort Codec, AD1819B, Jan. 1, 1999.

European Patent Office; International Preliminary Report on Patentability; PCT Application No. PCT/US2010/061827; Oct. 2, 2012.

* cited by examiner

SYSTEMS AND METHODS FOR CREATING IMMERSION SURROUND SOUND AND VIRTUAL SPEAKERS EFFECTS

RELATED APPLICATIONS

This application claims priority under 35 U.S.C. §119 to U.S. Patent Application No. 61/186,795, filed Jun. 12, 2009, entitled "Systems and Methods for Creating Immersion Surround Sound and Virtual Speakers Effects," which is hereby incorporated by reference.

TECHNICAL FIELD

The present invention relates generally to stereo audio reproduction and specifically to the creation of virtual speaker effects.

BACKGROUND ART

Stereophonic sound works on the principle that differences in sound heard between the two ears by a human get processed by the brain to give distance and direction to the sound. To exploit this effect, reproduction systems use recorded audio signals in left and right channels, which correspond to the sound to be heard by the left ear and the right ear, respectively. When the listener is wearing headphones, the left channel sound is directed to the listener's left ear and the right channel sound is directed to the listener's right ear. However, when sound is produced by a pair of speakers, sound from a left channel speaker can be heard by the listener's right ear and sound from a right channel speaker can be heard by the listener's left ear. When the listener moves relative to the location of the speakers the depth of feeling of the reproduced sound will change. Stereo speaker systems typically rely on the physical separation between the left and right speakers to produce stereophonic sound, but the result is often a sound that appears in front of the listener. Modern sound systems include additional speakers to surround the listener so that the sound appears to originate from all around the listener.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

SUMMARY OF INVENTION

The first embodiment described herein is a system for producing phantom speaker effects. It gives the listener the illusion that speakers are farther apart than they physically are. The system takes a copy of each stereo channel and scales them by a spread value and delays them by a predetermined time interval. Optionally a digital filter can be applied to emphasize certain sound characteristics. The delay value can be fixed or adjustable. These processed copies are then subtracted from the opposite channel and added to their originating channel. For example, the processed left channel is subtracted from the right channel and added to the left channel.

The second embodiment produces an immersion effect. Each stereo channel is separated into low frequency components (bass signal) and middle to high frequency components (treble) signal. The immersion effect is applied to each treble signal. The left treble signal is altered by adding a scaled version of the right treble signal where the right treble channel is scaled by a spread value. The right treble signal is altered by adding a scaled version of the left treble signal also scaled by the spread value. The altered left treble signal is combined with the left bass signal. The altered right treble signal is phase inverted prior to being combined with the right bass signal.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

DETAILED DESCRIPTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure.

In a first embodiment, speaker virtualization is employed to improve the quality of stereo reproduction by creating the illusion of either additional speakers or different speaker placement. For instance, speaker virtualization can make speakers that are physically close to each other, such as speakers on a notebook computer, produce sounds that appear to be wider apart than the speakers. This is known as "widening." Speaker virtualization can also make sounds appear to come from virtual speakers at locations without a physical speaker, such as in a simulated surround sound system that uses stereo speakers.

Figure 1:
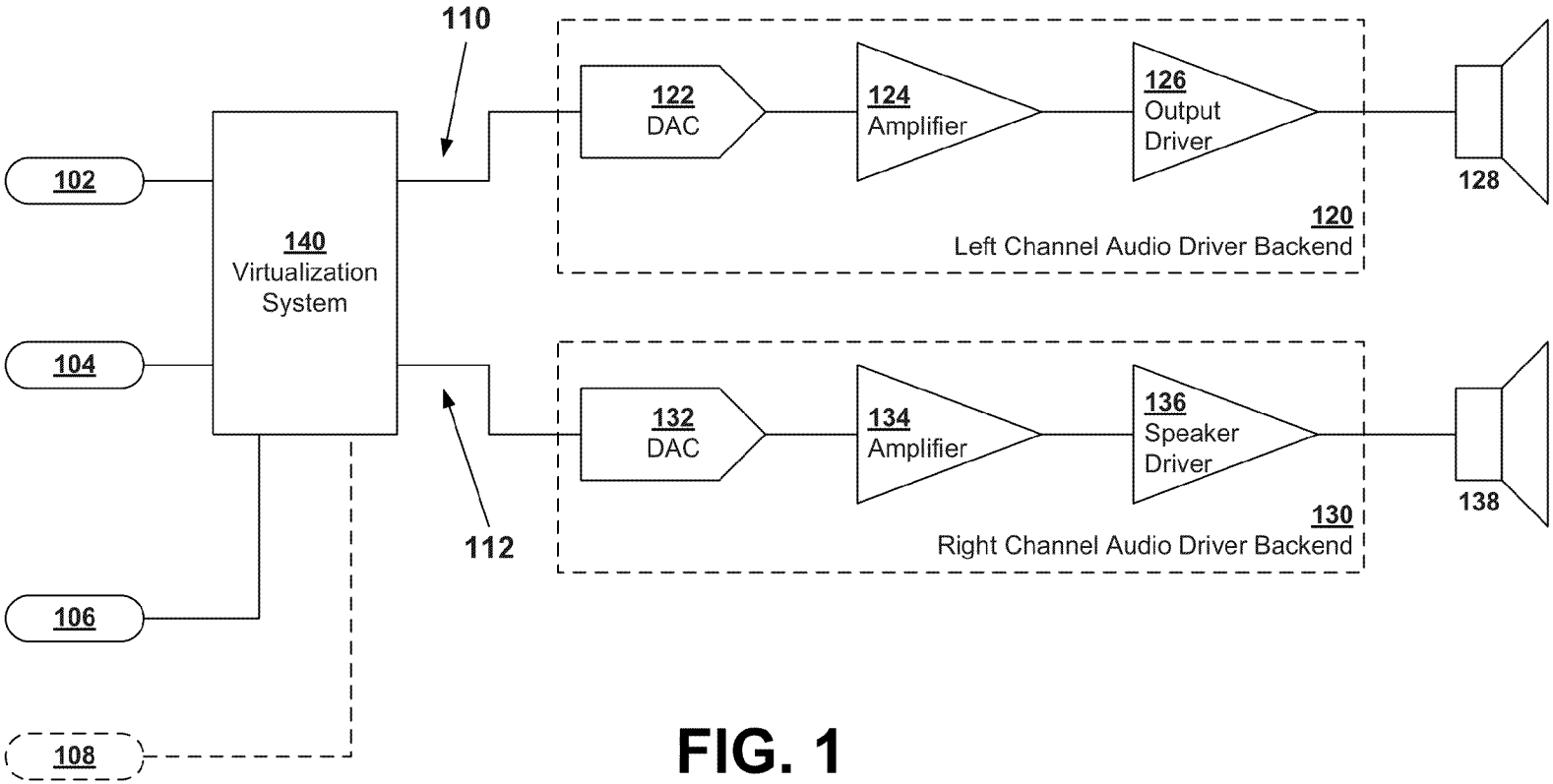
FIG. 1 is an embodiment of an audio driver with virtualization.

FIG. 1 is an embodiment of an audio driver with virtualization. Left audio signal 102 and right audio signal 104 are received by virtualization system 140 which produces virtualized left audio signal 110 and virtualized right audio signal 112. The left audio path includes left channel audio driver backend 120 which comprises digital to analog converter (DAC) 122, amplifier 124, and output driver 126. The destination of the left audio path is depicted by speaker 128. The right audio path includes right channel audio driver backend 130 which comprises DAC 132, amplifier 134, and output driver 136. The destination of the right audio path is depicted by speaker 138. In each audio driver backend, the DAC converts a digital audio signal to an analog audio signal; the amplifier amplifies the analog audio signal; and the output driver drives the speaker. In alternate embodiments, the amplifier and output driver are combined.

Virtualization system 140 can be part of the audio driver and implemented using software or, hardware. Alternatively, an application program such as a music playback application or video playback application can use virtualization system 140 to produce left and right channel audio data with a virtual effect and provide the data to the audio driver. Although virtualization system 140 is shown as implemented in the digital domain, it may also be implemented in the analog domain.

In the illustrative embodiment, virtualization system 140 receives a spread value 106 that controls the degree of the virtualization effect. For example, if virtualization system 140 has a widening effect, the spread value can control the degree to which the speakers appear to have widened. The virtualization system 140 optionally receives a delay value 108, which can be used to tune the virtualization system based on the physical configuration of the speakers.

Figure 2:
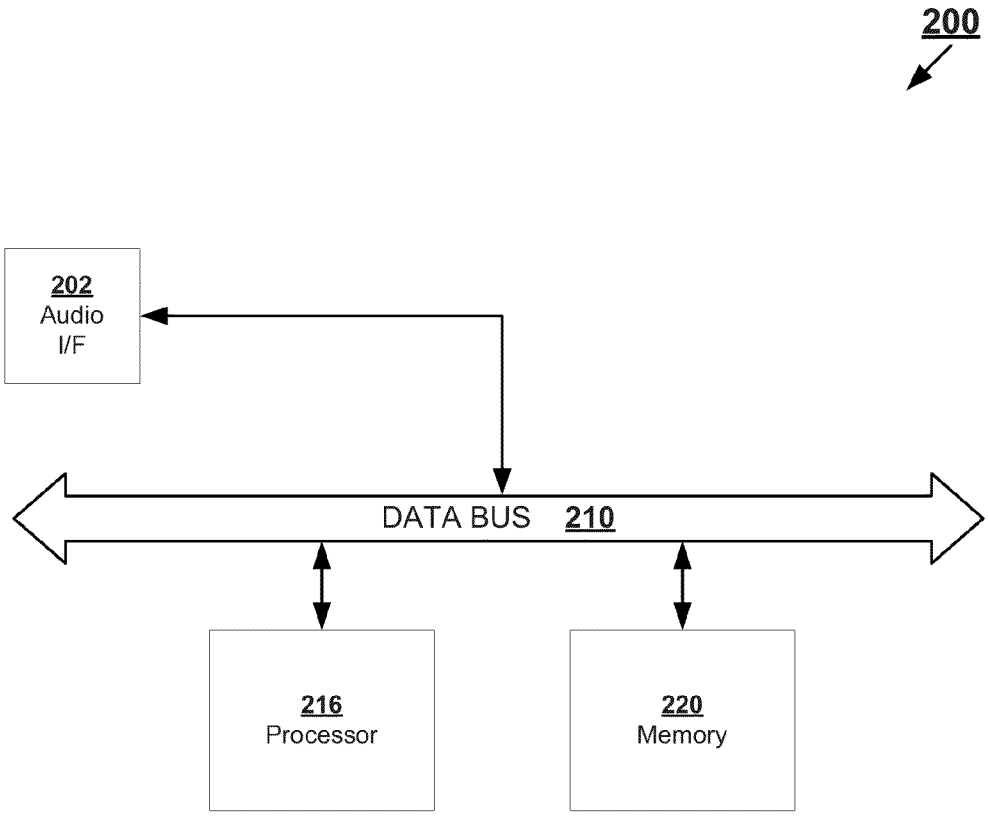
FIG. 2 is a diagram illustrating an embodiment of a virtualization system.

FIG. 2 is a diagram illustrating an embodiment of a virtualization system. In this embodiment, virtualization system 200 comprises memory 220, processor 216, and audio interface 202, wherein each of these devices is connected across one or more data buses 210. Though the illustrative embodiment shows an implementation using a separate processor and memory, other embodiments include an implementation purely in software as part of an application, and an implementation in hardware using signal processing components, such as delay elements, filters and mixers.

Audio interface 202 receives audio data which can be provided by an application such as music or video playback application, and provides virtualized audio data to the audio driver backend. Processor 216 can include a central processing unit (CPU), an auxiliary processor associated with the audio system, a semiconductor based microprocessor (in the form of a microchip), a macroprocessor, one or more application specific integrated circuits (ASICs), digital logic gates, a digital signal processor (DSP) or other hardware for executing instructions.

Memory 220 can include any one of a combination of volatile memory elements (e.g., random-access memory (RAM) such as DRAM, and SRAM) and nonvolatile memory elements (e.g., flash, read only memory (ROM), or nonvolatile RAM). Memory 220 stores one or more separate programs, each of which includes an ordered listing of executable instructions for implementing logical functions to be performed by the processor 216. The executable instructions include instructions for generating virtual audio effects and performing audio processing operations such as equalization and filtering. In alternate embodiments, the logic for performing these processes can be implemented in hardware or a combination of software and hardware.

Figure 3:
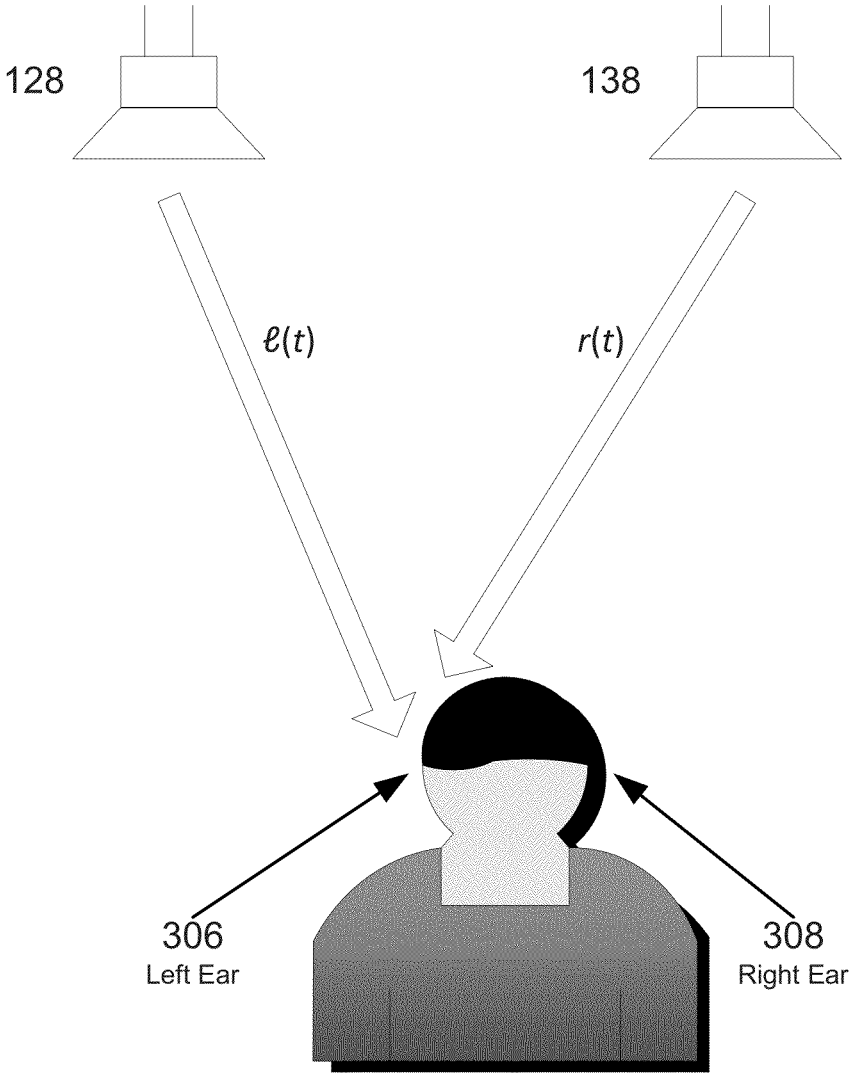
FIG. 3 shows an audio system with respect to a listener.

FIG. 3 shows an embodiment of an audio system comprising left channel speaker 128 and right channel speaker 138. Suppose left channel speaker 128 generates an acoustic signal $l(t)$ and right channel speaker 138 generates an acoustic signal $r(t)$. In a simple model without sound reflections, left ear 306 hears both acoustic signals, but due to the slightly longer distance the right channel signal has to travel, the right channel signal arrives a little later. Mathematically, the sound heard by left ear 306 can be expressed as $l_e(t)=l(t-\tau)+r(t-\tau-\Delta\tau)$, where $\tau$ is the transit time from left channel speaker 128 to left ear 306 and $\Delta\tau$ is the difference in transit time from left channel speaker 128 to left ear 306 and the transit time from right channel speaker 138 to left ear 306.

A delayed phase inverted opposite signal in each speaker can be added to provide a level of cross-cancellation of the opposite signals. For example, in the left speaker, rather than transmitting $l(t)$, the signal $l(t)-r(t-\Delta\tau)$ is transmitted to cancel out the right audio signal, leaving the left channel acoustic signal to be heard by left ear 306. Mathematically, the left ear hears $l(t-\tau)-r(t-\tau-\Delta\tau)+r(t-\tau-\Delta\tau)=l(t-\tau)$, which is the left channel acoustic signal. However, for right ear 308 to gain the same experience, the right speaker transmits $r(t)-l(t-\Delta\tau)$ instead of $r(t)$. As a result of the process of cross-cancellation, left ear 306 actually hears $l(t-\tau)-r(t-\tau-\Delta\tau)+(r(t-\tau-\Delta\tau)-l(t-\tau-2\Delta\tau))=l(t-\tau)-l(t-\tau-2\Delta\tau)$ (an similarly for right ear 308, it hears $r(t-\tau)-r(t-\tau-2\Delta\tau)$). If a signal is slow changing such as the bass components of an audio signal then $l(t-\tau)\approx l(t-\tau-2\Delta\tau)$, so the overall effect of cross cancellations tends to cancel bass components of an audio signal.

Figure 4:
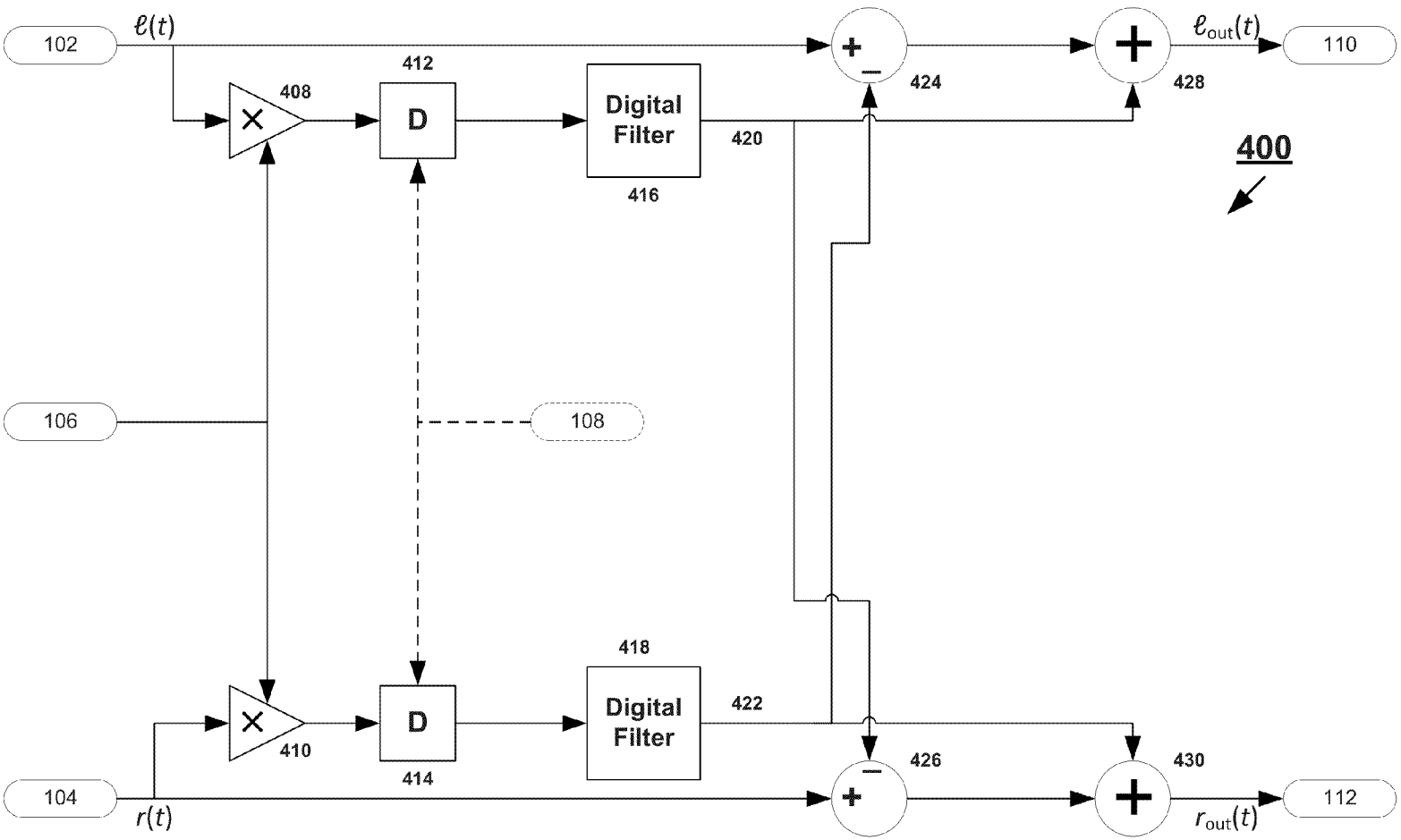
FIG. 4 shows an embodiment of a speaker virtualization system.

FIG. 4 shows an embodiment of a speaker virtualization system 400 that gives the illusion of speakers with greater spatial separation. System 400 receives left channel signal 102 and right channel signal 104. Spread value 106 is also received by system 400. Spread value 106 controls the intensity of the widening effect. A copy of the left channel signal is scaled by spread value 106 using multiplier 408, then delayed by delay element 412 and filtered by digital filter 416. Likewise a copy of the right channel signal is scaled by spread value 106 using multiplier 410 then delayed by delay element 414 and filtered by digital filter 418. The left channel signal output processed by digital filter 416 shown as signal 420 is then subtracted from the right channel by mixer 426 and added back to the original left channel signal by mixer 428 to generate left channel output signal 110. Similarly, the right channel signal output processed by digital filter 418 shown as signal 422 is subtracted from the left channel by mixer 424 and added back to the original right channel by mixer 430 to generate right channel output signal 112.

Mathematically, if left channel signal 102 is represented by $l(t)$ and right channel signal 104 is represented by $r(t)$ and digital filter 416 transforms $l(t)$ into $l'(t)$ and digital filter 418 transforms $r(t)$ into $r'(t)$ then the resultant left channel signal output by digital filter 416 is $s\cdot l'(t-\Delta\tau)$, where s is spread value 106 and $\Delta\tau$ is the delay imposed by delay unit 412. Similarly, the resultant right channel signal output by digital filter 418 is $s\cdot r'(t-\Delta\tau)$. Therefore, left channel output signal 110 is $l_{out}(t)=l(t)-s\cdot r'(t-\Delta\tau)+s\cdot l'(t-\Delta\tau)$ and the right channel output signal is 112 is $r_{out}(t)=r(t)-s\cdot l'(t-\Delta\tau)+s\cdot r'(t-\Delta\tau)$. While for simplicity, the equations are expressed as analog signals, the processing can be performed digitally as well on $l[n]$ and $r[n]$ with their digital counterparts.

The spread value 106 influences the strength of the widening effect by controlling the volume of the virtual sound. If the spread value is zero, there is no virtualization, only the original sound. Generally speaking, the larger the spread value, the louder the virtual sound effect. As described in the present embodiment, the virtual sound and cross-cancellation mixed with the original audio data can be used to produce an audio output that would sound like an extra set of speakers outside of the original set of stereo speakers.

Figure 5:
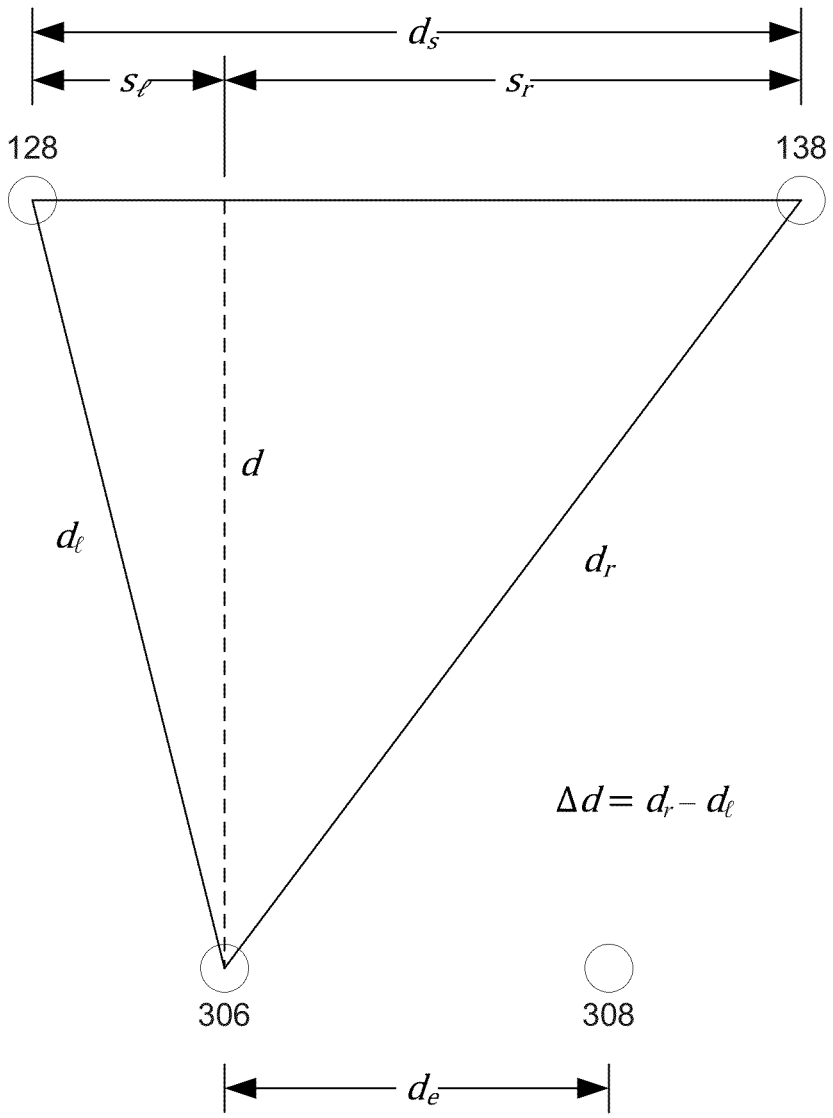
FIG. 5 shows an embodiment of distances used to calculate the desired delay $\Delta\tau$.

An additional feature of the embodiment described in FIG. 4 is in the choice of a predetermined delay value 108 for delay elements 412 and 414. In the scenario of an audio driver for a notebook computer, the selection of delay value 108 can be important for achieving certain wide spatial effects. The delay is calculated based on the distance between human ears ($d_e$), distance between speakers ($d_s$) and distance between the listener and the speakers (d). FIG. 5 shows the distances used to calculate the desired delay $\Delta\tau$. This delay is based on the difference in distances between a given ear and each speaker. The calculation in FIG. 5 shows how the delay is calculated with respect to left ear 306. The difference in distance between left ear 306 and left speaker 128 is given by $d_l$ and the distance between left ear 306 and right speaker 104 is given by $d_r$. These distances define a two triangles, with the third sides represented by the distances $s_l$ and $s_r$, respectively. If an assumption is made that the listener is centered between the speakers then $$S_l = \frac{d_s - d_e}{2} \text{ and } S_r = \frac{d_s + d_e}{2}.$$

Using the Pythogorean theorem, $$d_\ell = \frac{1}{2}\sqrt{(d_s - d_e)^2 + 4d^2} \text{ and } d_r = \frac{1}{2}\sqrt{(d_s + d_e)^2 + 4d^2},$$

so the difference between the distances is $$\Delta d = \frac{1}{2}\left(\sqrt{(d_s + d_e)^2 + 4d^2} - \sqrt{(d_s - d_e)^2 + 4d^2}\right).$$

The desired delay can be calculated from Δd by multiplying Δd by the speed of sound.

In one embodiment, the distance between human ears $d_e$ is assumed to be approximately 6 inches. For notebook computers, the distance between speakers $d_s$ typically ranges between 6 inches to 15 inches, depending on the configuration. The distance an average person sits from their notebook computers d is assumed to be between 12 to 36 inches in the present embodiment. For smaller electronic devices such as a portable DVD player, the distances between the individual speakers and the speakers to the user could even be smaller. Exemplary values are given by Table 1. Given the above assumptions, the delays fall between the range of 2 to 11 samples when using 48 kHz sampling rate. For higher sampling rates, such as 96 kHz and 192 kHz, the delay expressed in terms of samples increases proportionally with sampling rate. For example in the last case in Table 1 for 192 kHz, the delay is scaled to 11*192/48=44 samples.

TABLE 1

| $d_s$ (in) | d (in) | Δd (in) | Δτ (ms) | Samples @ 44.1 kHz | Samples @ 48 kHz |
|---|---|---|---|---|---|
| 6 | 36 | 0.50 | 0.04 | 2 | 2 |
| 9 | 30 | 0.89 | 0.07 | 3 | 3 |
| 10 | 26 | 1.13 | 0.08 | 4 | 4 |
| 12 | 24 | 1.45 | 0.11 | 5 | 5 |
| 8 | 15 | 1.52 | 0.11 | 5 | 5 |
| 14 | 22 | 1.81 | 0.13 | 6 | 6 |
| 15 | 12 | 3.13 | 0.23 | 10 | 11 |

Delay element 412 and delay element 414 can be implemented with variable delay units allowing the system 400 to be configurable to different sound system scenarios. As a result, in some embodiments of system 400, the delay is programmable through the introduction of delay value 108 which can adjust the delay on delay elements 412 and 414.

Another feature of system 400 is the addition of the processed signal left channel signal back into the left channel signal and the addition of the processed right channel signal back into the right channel signal. Traditional cross cancellation suffers from loss of center sound and loss of bass. The approach of the present embodiment produces a sound without a significant loss of center sound and bass, preserving the sound quality during cross cancellation. Empirical comparisons between virtualized audio samples with and without the additions by mixers 428 and 430 were compared. Superior virtualization is exhibited by the system with mixer 428 and 430.

Traditional cross-cancellation causes a loss of bass. For example examining the left channel mathematically, if $l_b(t)$ represents the low frequency components of the left channel signal, the left ear would hear $l_b(t)-l_b(t-2\Delta\tau)$. However because there is very little variation over time in the low frequency components of $l_b$, $l(t)\approx l(t-2\Delta\tau)$. Thus the low frequency components of the left channel are cancelled for the left ear.

In the case of system 400, the digital filters can be used to preserve the original bass frequencies in the output signal by suppressing the bass frequencies in the delayed scaled copies. The output of the digital filters can be expressed mathematically as $l'_b\approx r'_b\approx 0$. As a result the low frequency components of the left output channel would be $l_{out_b}(t)=l_b(t)-s\cdot r'_b(t-\Delta\tau)+s\cdot l'_b(t-\Delta\tau)\approx l_b(t)-s\cdot 0+s\cdot 0=l_b(t)$, so the bass frequencies remain essentially unaltered.

With or without the digital filters, both bass frequencies and center sound are preserved. Mathematically, when digital filters are present, $l_{out_b}(t)=l_b(t)-s\cdot r'_b(t-\Delta\tau)+s\cdot l'_b(t-\Delta\tau)$ and $r_{out_b}(t)=r_b(t)-s\cdot l'_b(t-\Delta\tau)+s\cdot r'_b(t-\Delta\tau)$. The left ear hears $l_{out_b}(t)+r_{out_b}(t-\Delta\tau)$ which is equal to $l_b(t)-s\cdot r'_b(t-\Delta\tau)+s\cdot l'_b(t-\Delta\tau)+r_b(t-\Delta\tau)-s\cdot l'_b(t-2\Delta\tau)+s\cdot r'_b(t-2\Delta\tau)$. Because the bass signals are slow changing $r'_b(t-\Delta\tau)\approx r'_b(t-2\Delta\tau)$ and $l'_b(t-\Delta\tau)\approx l'_b(t-2\Delta\tau)$, so $l_{out_b}(t)+r_{out_b}(t-\Delta\tau)\approx l_b(t)+r_b(t-\Delta\tau)$, which is what the left ear would hear if the bass frequencies were unaltered by system 400. In the case of center sound $l\approx r$ so $l'\approx r'$, then $l_{out}(t)=l(t)-s\cdot r'(t-\Delta\tau)+s\cdot l'(t-\Delta\tau)\approx l(t)$. For right channel, $r_{out}(t)=r(t)-s\cdot l'(t-\Delta\tau)+s\cdot r'(t-\Delta\tau)\approx r(t)$. Therefore center sound is also preserved by system 400.

The use of digital filters 416 and 418 is optional but, in addition to preserving bass frequencies, they can amplify the virtualization effect of certain frequencies. For example, it may be desirable to apply speaker virtualization to certain sounds such as speech or a movie effect and not to apply speaker virtualizations to other sounds such as background sounds. By applying filters 416 and 418, specific sounds are emphasized in the virtualization process.

Figure 6:
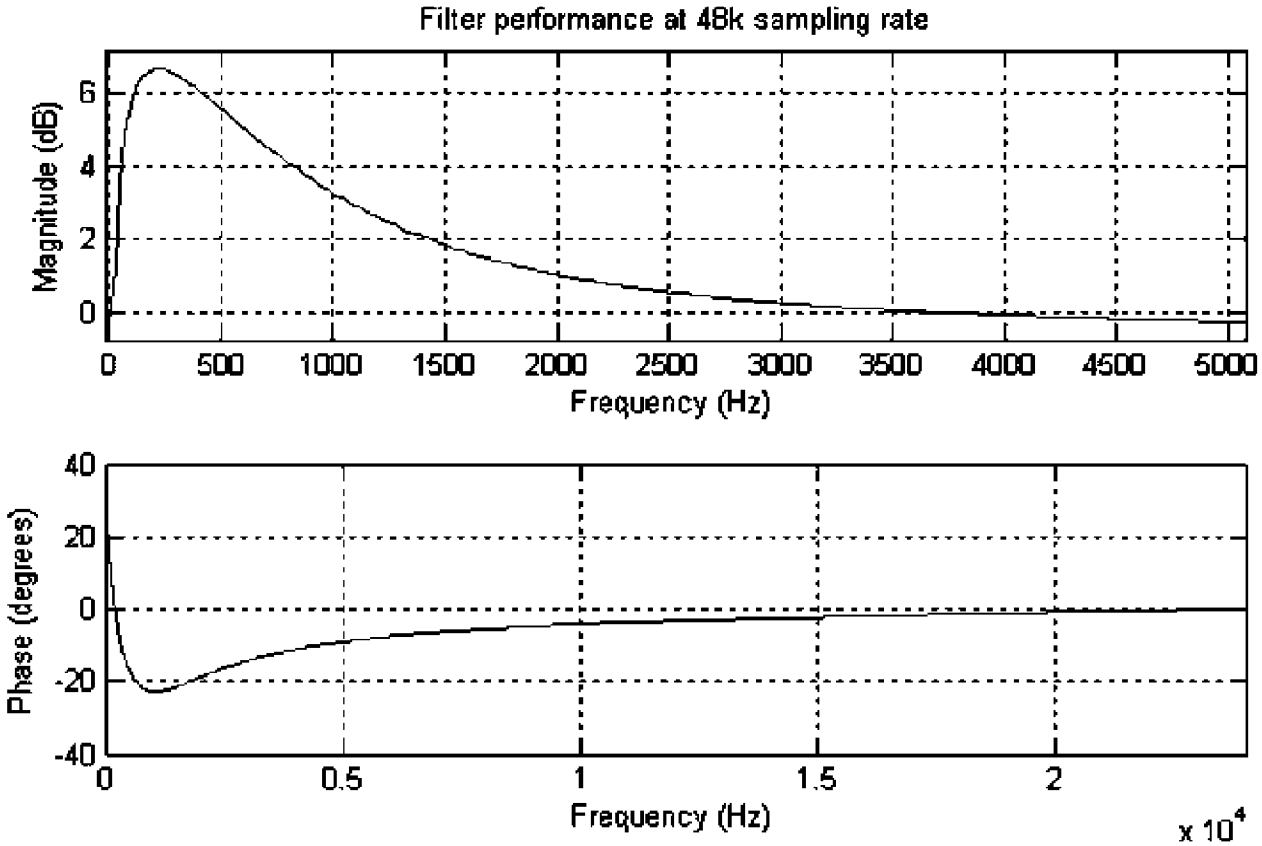
FIG. 6 illustrates the frequency response of an exemplary pair of digital filters used in system 400.

FIG. 6 illustrates the frequency response of an exemplary pair of digital filters. The filters in this embodiment cause the virtualization system to emphasize the frequencies between about 100 Hz and 1.2 kHz, which is generally desirable for music. The filters used here are linear digital filters, but other filter types could be used including non-linear and/or adaptive filters. Some of those filters may better isolate the sounds desired for virtualization, but they can also be more costly in terms of hardware or processing power. The choice of filter type allows for the trade-off between the desired effect and the resource cost.

Figure 7:
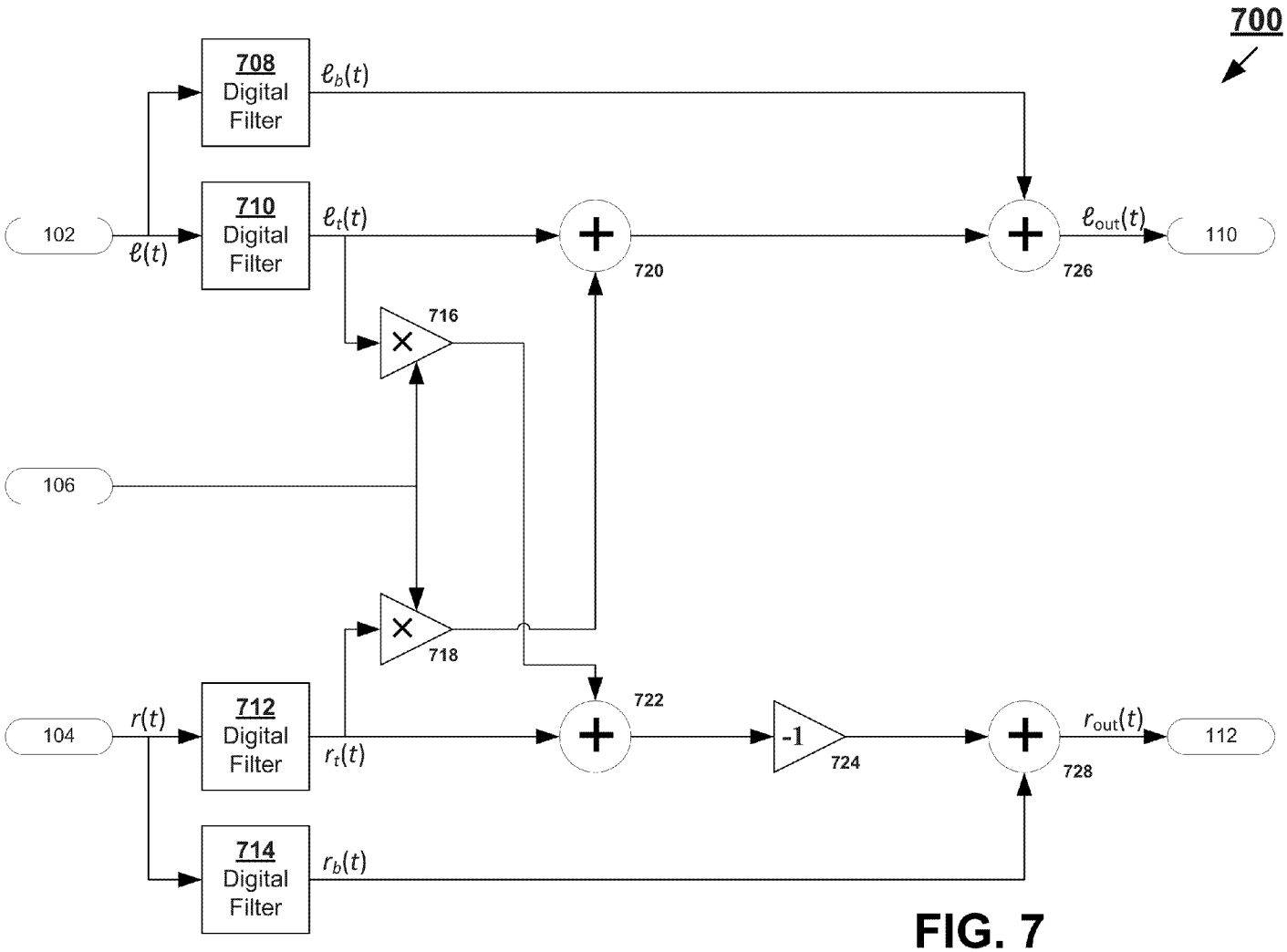
FIG. 7 illustrates another embodiment of a virtualization system.

FIG. 7 illustrates another embodiment of a virtualization system. Virtualization system 700 creates an immersion effect. Left channel input signal 102, shown mathematically as l(t) is separated into its high frequency components $l_t(t)$ and low frequency components $l_b(t)$, by complementary crossover filters 708 and 710. Filter 710 allows frequencies above a given crossover frequency to pass whereas filter 708 allows frequencies below the given crossover frequency to pass. Similarly, right channel input signal 104, shown mathematically as r(t) is separated into its high frequency components $r_t(t)$ and low frequency components $r_b(t)$ by complementary crossover filters 712 and 714. A copy of $r_t(t)$ is scaled by spread value 106 using multiplier 718 and added to $l_t(t)$ by mixer 720. The result is added back with the low frequency components by mixer 726. Left channel output signal 110 can be expressed mathematically as $l_{out}(t)=l_b(t)+l_t(t)+s\cdot r_t(t)$, where s represents the spread value. A copy of $l_t(t)$ is scaled by spread value 106 using multiplier 716 and added to $r_t(t)$ by mixer 722. The resultant mixed signal is then phase inverted by phase inverter 724 and added to back with low frequency components by mixer 728. The phase inversion phase shifts the signal by essentially 180°, which is equivalent to multiplication by −1. Mathematically, right channel output signal 112 can be expressed as $r_{out}(t)=r_b(t)-r_t(t)-s\cdot l_t(t)$.

The immersion effect in the present embodiment is produced when the left ear and right ear respectively perceive two signals that are 180° out of phase. Experiments show the resulting effect is a sound perceived to be near the listener's ears that appears to diffuse and "jump out" right next to the listener's ears. The use of the spread value in system 700 changes the nature of the immersion effect. For example if the spread value is set to zero, the right channel signal still has the high frequency components $r_t(t)$ phase inverted relative to the input signal which still yields the immersion effect. If the spread value is zero, $l_{out}(t)=l_b(t)+l_t(t)=l(t)$, but $r_{out}(t)=r_b(t)-r_t(t)$. If the spread value is one, $l_{out}(t)=l_b(t)+l_t(t)+r_t(t)$, and $r_{out}(t)=r_b(t)-r_t(t)-l_t(t)$. Except for the bass frequencies, as the spread value changes from zero to one, the output goes from stereo immersion to monaural immersion.

Figure 8:
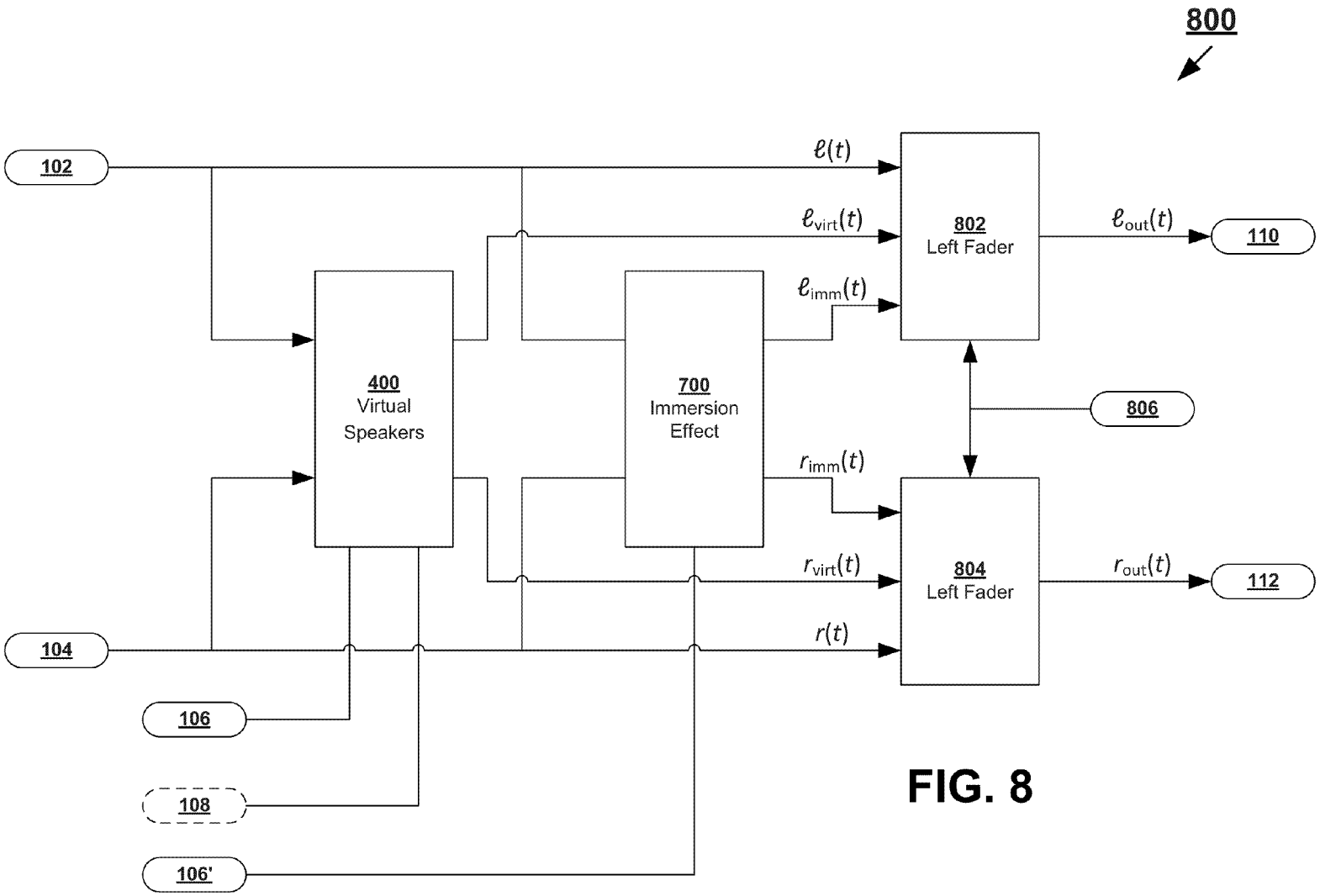
FIG. 8 shows an embodiment of a virtualization system offering speaker virtualization as well as the immersion effect.

Both the speaker virtualization and the immersion effect can be offered to the end user within the same virtualization system. FIG. 8 shows an embodiment of a virtualization system offering speaker virtualization as well as the immersion effect. Virtualization system 800 comprises speaker virtualization system 400 and immersion effect system 700 which receives spread value 106'. Virtualization system 800 receives effects input 806 which specifies whether to employ the speaker virtualization effect, the immersion effect or no effect. Left fader 802 facilitates a smooth transition between the different modes in the left channel and right fader 804 facilitates a smooth transition between the different modes in the right channel.

Various fader techniques can be employed within left fader 802 and right fader 804. One example of a three-way fader that can be employed is a mixer where left audio output signal 110 can be expressed as $l_{out}(t)=\alpha l(t)+\alpha_{imm}l_{imm}(t)+\alpha_{virt}l_{virt}(t)$, where $l_{imm}(t)$ is the left output audio signal of immersion effect system 700 and $l_{virt}(t)$ is the left output audio signal of virtual speaker system 400 and right audio output signal 112 can be expressed as $r_{out}(t)=\alpha r(t)+\alpha_{imm}r_{imm}(t)+\alpha_{virt}r_{virt}(t)$, where $r_{imm}(t)$ is the right output audio signal of immersion effect system 700 and $r_{virt}(t)$ is the right output audio signal of virtual speaker system 400 and $\alpha$, $\alpha_{imm}$, and $\alpha_{virt}$ are gain coefficients. When immersion effects are chosen through input 806, $\alpha_{imm}$ is increased gradually until it reaches 1 while $\alpha$ and $\alpha_{virt}$ are decreased gradually until they both reach 0. When virtual speakers are chosen through input 806, $\alpha_{virt}$ is increased gradually until it reaches 1 while $\alpha$ and $\alpha_{imm}$ are decreased gradually until they both reach 0. When all effects are turned off by selecting "no effects" through input 806, $\alpha$ is increased gradually until it reaches 1 while $\alpha_{virt}$ and $\alpha_{imm}$ are decreased gradually until they both reach 0. The gradual increase and decrease of the three gain factors can be linear or can employ exponential decays or another monotonic function. By using a smooth fader, a user can transition into or out of an effect without audible glitches during the transition.

The embodiments described above make the listener feel virtual speakers as well as experience immersion. Empirical evidence has shown these systems give a superior quality of the surround and spatial sound experience, while requiring little CPU power so it can be implemented in systems with and without a hardware DSP and embedded systems.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

The invention claimed is:

1. An audio circuit for producing phantom speaker effects comprising:

a left multiplier operable to multiply a left audio signal l(t) by a spread value s to generate a signal s*l(t);

a left delay element operable to delay the spread left audio signal by a delay value Δt to generate a signal s*l(t−Δt);

a right multiplier operable to multiply a right audio signal r(t) by the spread value s to generate a signal s*r(t);

a right delay element operable to delay the spread right audio signal by the delay value Δt to generate a signal s*r(t−Δt);

a first left mixer operable to subtract the right audio signal processed by the right multiplier and right delay element from the first left audio signal to generate a signal l(t)−s*r(t−Δt);

a first right mixer operable to subtract the left audio signal processed by the left multiplier and left delay element from the right audio signal to generate a signal r(t)−s*l(t−Δt);

a second left mixer operable to add the left audio signal processed by the left multiplier and left delay element to the first left mixed audio signal to generate a signal l(t)+s*l(t−Δt)−s*r(t−Δt); and a second right mixer operable to add the right audio signal processed by the right multiplier and right delay element to the first right mixed audio signal to generate a signal r(t)+s*r(t−Δt)−s*l(t−Δt).

2. The audio circuit of claim 1 further comprising:

a left digital filter operable to select desired sounds in the left audio signal; and a right digital filter operable to select desired sounds in the right audio signal.

3. The audio circuit of claim 1 wherein the delay value is adjustable.

4. The audio circuit of claim 1 wherein the delay value is fixed.

5. The audio circuit of claim 1 wherein the delay value is 2 to 44 samples and the left channel signal and right channel signal are sampled at 44.1 kHz, 48 kHz, 96 kHz or 192 kHz.

6. The audio circuit of claim 1 further comprising:

a left digital to analog converter (DAC) operable to receive the left audio signal from the second left mixer and convert the left audio signal into a left analog audio signal;

a left amplifier operable to amplify the left analog audio signal;

a right DAC operable to convert the right audio signal from the second right mixer and convert the right audio signal; and a right amplifier operable to amplify the right analog audio signal.

7. The audio circuit of claim 6, further comprising a left output driver for driving in a left speaker and a right output driver for driving a right speaker.

8. The audio circuit of claim 1 further comprising:

an immersion effect system operable to generate a left output signal and a right output signal;

a left fader operable to receive a mode selection input and to select the left output signal of the immersion effect system, the left audio signal, or an output of the second left mixer on the basis of the mode selection input; and a right fader operable to receive the mode selection input and to select the right output signal of the immersion effect system, the right audio signal or an output of the second right mixer on the basis of the mode selection input, wherein the left fader and right fader provide a smooth transition between modes when the mode selection input changes.

9. An audio circuit for creating a 3D immersion effect comprising:

a left crossover filter operable to separate a left audio signal into a left low frequency component signal $l_b(t)$ and a left high frequency component signal $l_t(t)$;

a right crossover filter operable to separate a right audio signal into a right low frequency component signal $r_b(t)$ and a right high frequency component signal $r_b(t)$;

a left multiplier operable to scale the left high frequency component signal $l_r(t)$ by a spread value s to produce a scaled left high frequency component signal $s*l_t(t)$;

a right multiplier operable to scale the right high frequency component signal $r_t(t)$ by the spread value s to produce a scaled right high frequency component signal $s*r_t(t)$;

a first left mixer operable to add the scaled right high frequency component signal to the left high frequency component signal to generate a signal $l_t(t)+s*r_t(t)$;

a second left mixer operable to add the left low frequency component $l_b(t)$ to the left high frequency component signal received from the first left mixer $l_t(t)+s*r_t(t)$ to generate a signal $l_b(t)+l_t(t)+s*r_t(t)$;

a first right mixer operable to add the scaled left high frequency component signal $s*l_t(t)$ to the right high frequency component signal $r_t(t)$ to generate a signal $r_t(t)+s*l_t(t)$;

a phase inverter-operable to phase invert the right high frequency component signal received from the first right mixer to generate a signal $-r_t(t)-s*l_t(t)$; and a second right mixer operable to add the right low frequency component to the right high frequency component signal received from the phase inverter to generate a signal $r_b(t)-r_t(t)-s*l_t(t)$.

10. The audio circuit of claim 9 wherein the left crossover filter comprises a left low pass filter and a left high pass filter with a common crossover frequency and the right crossover filter comprises a right low pass filter and a right high pass filter with the common crossover frequency.

11. The audio circuit of claim 9 further comprising:

a left digital to analog converter (DAC) operable to receive the left audio signal from the second left mixer and convert the left audio signal into a left analog audio signal;

a left amplifier operable to amplify the left analog audio signal;

a right DAC operable to convert the right audio signal from the second right mixer and convert the right audio signal; and a right amplifier operable to amplify the right analog audio signal.

12. The audio circuit of claim 11, further comprising a left output driver for driving a left speaker and a right output driver for driving a right speaker.

13. A method for producing phantom speaker effects comprising:

producing a processed left channel signal l(t) comprising:

scaling a left channel signal by a spread value s to generate a signal s*l(t); and delaying the left channel signal by a predetermined time Δt to generate a signal s*l(t−Δt);

producing a processed right channel signal r(t) comprising:

scaling a right channel signal by the spread value s to generate a signal s*r(t); and delaying the right channel signal by the predetermined time Δt to generate a signal s*r(t−Δt);

subtracting the processed right channel signal from the left channel signal to generate a left mixed signal l(t)−s*r(t−Δt);

subtracting the processed left channel signal from the right channel signal to generate a right mixed signal r(t)−s*l(t−Δt);

adding the processed left channel signal to the left mixed signal to generate a signal l(t)+s*l(t−Δt)−s*r(t−Δt); and adding the processed right channel signal to the right mixed signal to generate a signal r(t)+s*r(t−Δt)−s*l(t−Δt).

14. The method of claim 13 wherein producing a processed left channel signal further comprises:

selecting desired sounds in the left channel signal with a digital filter.

15. The method of claim 13 wherein producing a processed right channel signal further comprises:

selecting desired sounds in the right channel signal with a digital filter.

16. The method of claim 13 wherein the predetermined time is adjustable.

17. The method of claim 13 wherein the predetermined time is fixed.

18. The method of claim 13 wherein the predetermined time is 2 to 44 samples and the left channel signal and right channel signal are sampled at 44.1 kHz, 48 kHz, 96 kHz or 192 kHz.

19. A method of creating 3D immersion effect in a sound system comprising:

separating a left channel signal into a left low frequency component signal and a left high frequency component signal;

separating a right channel signal into a right low frequency component signal and a right high frequency component signal;

scaling the left high frequency component signal by a spread value to produce a scaled left high frequency component signal;

scaling the right high frequency component signal by the spread value to produce a scaled right high frequency component signal;

adding the left low frequency component signal, the left high frequency component signal and the scaled right high frequency component signal; and subtracting from the right low frequency components signal, both the right high frequency component signal and the scaled left high frequency component signal.

20. The method of claim 19 wherein:

separating the left channel signal comprises applying a first low pass filter and a first high pass filter with a common crossover frequency; and wherein separating the right channel signal comprises applying a second low pass filter and a second high pass filter with the common crossover frequency.

* * * * *

UNITED STATES PATENT AND TRADEMARK OFFICE

CERTIFICATE OF CORRECTION

PATENT NO. : 8,577,065 B2
APPLICATION NO. : 12/814425
DATED : November 5, 2013
INVENTOR(S) : Harry K. Lau It is certified that error appears in the above-identified patent and that said Letters Patent is hereby corrected as shown below:

In the Claims:

Column 8, line 60, delete "in"
Column 9, line 17, replace "$1_r(t)$" with "$1_t(t)$"

Signed and Sealed this
Seventh Day of January, 2014

Margaret A. Focarino

Margaret A. Focarino
*Commissioner for Patents of the United States Patent and Trademark Office*